US006024642A

United States Patent [19]

Stupak

[11] Patent Number: 6,024,642

[45] Date of Patent: Feb. 15, 2000

[54] GAME OF CHANCE

[76] Inventor: Bob Stupak, 910 Rancho Cir., Las Vegas, Nev. 89107

[21] Appl. No.: 08/991,737

[22] Filed: Dec. 16, 1997

Related U.S. Application Data

[63] Continuation of application No. 08/632,726, Apr. 10, 1996, Pat. No. 5,695,402.

[51] Int. Cl.[7] ..... G09F 17/34

[52] U.S. Cl. ..... 463/20; 273/143 R

[58] Field of Search ..... 273/143 R; 463/20, 463/21

[56] References Cited

U.S. PATENT DOCUMENTS

| | | | |
|---|---|---|---|
| 4,570,934 | 2/1986 | Smyth | 273/143 R |
| 4,669,731 | 6/1987 | Clarke | 273/143 R |
| 5,067,712 | 11/1991 | Georgilas | 463/21 |

OTHER PUBLICATIONS

Slot 1 by Richard M. Bueschel, "Mills Futurity Bell Machine", p. 136, 1978.

*Primary Examiner*—Benjamin H. Layno
*Attorney, Agent, or Firm*—Quirk & Tratos

[57] ABSTRACT

A game of chance and a gaming machine for playing the game are disclosed. The gaming machine preferably comprises a slot or video machine which has been modified to include a successive loss counter and a loss indicator, and to pay a jackpot amount if the results of a predetermined number of successive games played on the machine are losing results. In accordance with the method, a player activates the machine by placing a bet and then plays the game. If the result of the game is a predetermined losing combination, the loss indicator is illuminated. If the particular loss results cumulatively in a predetermined number of successive losing games played on the machine, the player is paid a winning jackpot amount.

12 Claims, 3 Drawing Sheets

GAME OF CHANCE

CROSS REFERENCE TO RELATED APPLICATION

This application is a continuation application of application Ser. No. 08/632,726 filed Apr. 10, 1996 and entitled GAME OF CHANCE, now U.S. Pat. No. 5,695,402.

FIELD OF THE INVENTION

The present invention relates to a game of chance, and more particularly, to one in which a player is paid a very large potential winning jackpot when a predetermined number of successive losing games are the outcomes of games played on the machine.

BACKGROUND OF THE INVENTION

Slot machines and similar video or video poker machines are very popular among gamblers. Play of both games has the drawback that upon losing several games in a row, players often lose their interest to continue to play.

Slot machines typically have 3, 4 or more reels, with a number of different indicia located on each reel. Upon activation of the machine by a player placing a bet, the reels spin for some time, and then stop. If the reels stop in a position where the indicia displayed on the reels form a predetermined winning combination, the player is a winner and receives a payout. If the reels stop in a position in which the indicia form a losing combination, the player loses his bet.

Similar machines utilize video screen technology in the place of spinning reels, but involve essentially the same game of chance.

Another popular game of chance is "video poker." In this game, a player bets that he or she will be able to create a predetermined hand from a number of dealt cards, the cards illustrated on video screen displays.

A player places a bet, such as by inserting a coin or playing a credit to start the game. The machine then "deals" five cards to the player, displaying them on a video screen. The player elects whether to keep any or all of the cards, and then instructs the machine to replace any discarded cards. If the resulting five cards form a predetermined winning hand, such as "three-of-a-kind," then the player is a winner and is paid a winning amount. If the player does not receive a predetermined winning hand, the player is a loser and his bet is retained by the machine.

All of these games suffer from a serious drawback. First, from the player's prospective, if he loses several consecutive hands or plays, the game is not fun and is disappointing. From the casino standpoint, this player, who may believe he is having a streak of "bad luck" having not received a predetermined winning combination or hand for several plays, is likely to quit playing. This causes the casino to lose a betting patron.

There exists a need for a game in which players are rewarded for both winning and losing play.

SUMMARY OF THE INVENTION

In accordance with the present invention there is a gaming machine and method of game play. The gaming machine preferably comprises a slot or video-poker machine which includes an indicator for indicating the number of successive losing game results, and which pays a player a very large, or preferably maximum jackpot amount when a predetermined number of successive games are losing games.

The method of play is as follows. A player places a bet and activates the machine. The player plays the game. If the result of the game is a predetermined winning combination, the player receives a winning payout. If the result of the game is a predetermined losing combination (i.e., no payment), the indicator indicates a loss, or increments the number of successive losses shown if the loss is a successive loss.

If the result of the game is the last loss of a predetermined number of successive losses, such as ten, the player is paid a large jackpot amount payable by the machine.

Further objects, features, and advantages of the present invention over the prior art will become apparent from the detailed description of the drawings which follows, when considered with the attached figures.

DETAILED DESCRIPTION OF THE PREFERRED EMBODIMENT

Figure 1:
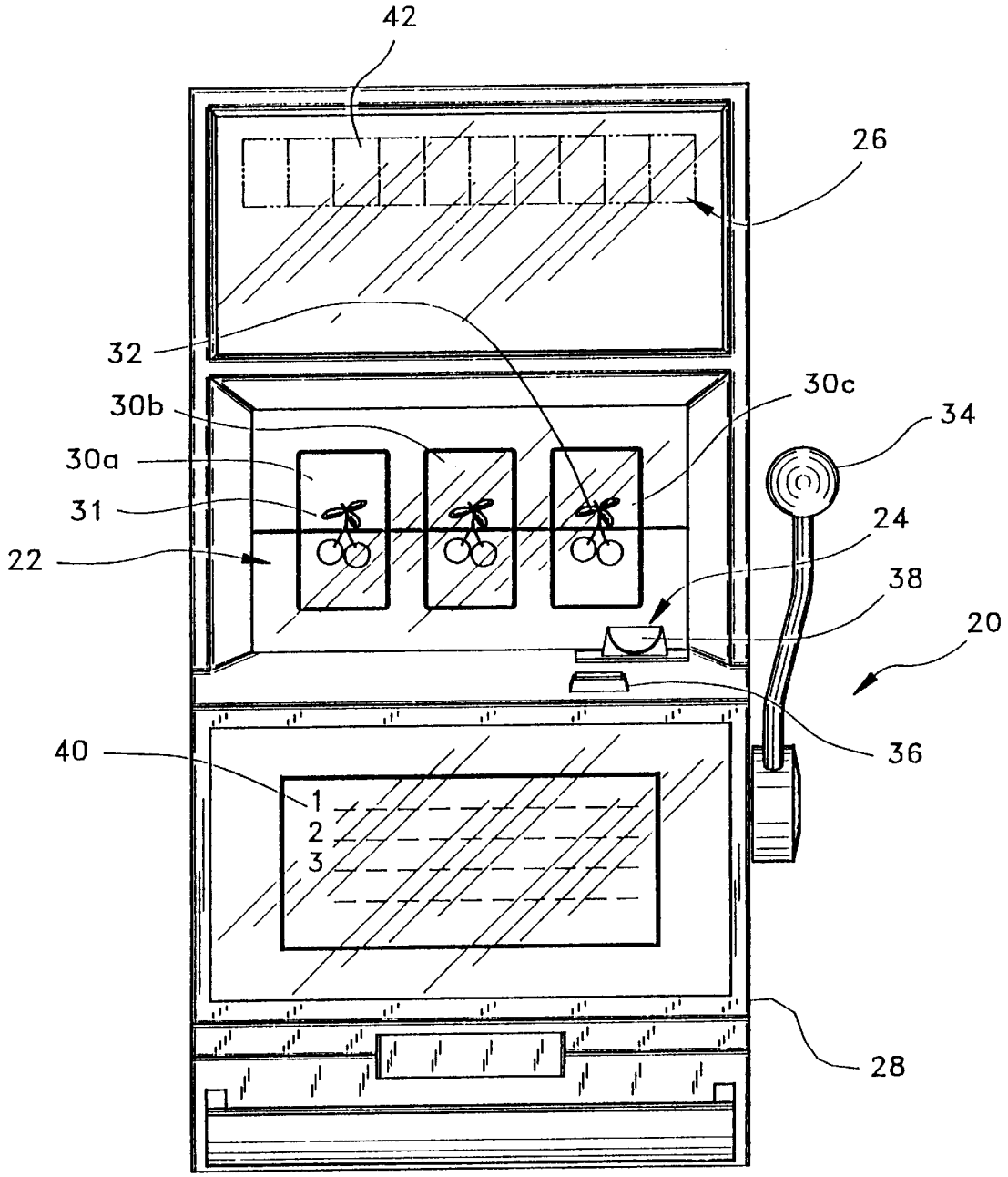
FIG. 1 illustrates a gaming machine in accordance with the present invention.

FIG. 1 illustrates a gaming machine 20 in accordance with the present invention. In general, the machine 20 preferably comprises a slot or video-poker machine including game display means 22 and bet acceptance means 24, and further including indicator means 26 for indicating successive losses and thus how close a player is to winning the jackpot amount.

In accordance with a method of play, a player activates the machine 20 by placing a bet. The machine 20 displays gaming indicia on the game display means 22, with the player playing the game in accordance with the particular method of play of that game. If the player wins the game, such as by receiving a predetermined winning combination of indicia, the player is paid a winning amount. If the player loses the game, then the indicator means 26 indicates that a loss has occurred.

Preferably, the indicator means 26 indicates the number of successive losses of games played on that machine. If the result of games played on the machine 20 is a loss a predetermined number of times in succession, the player is preferably declared a winner, and receives a special jackpot amount.

The game will now be described in more detail with reference to FIG. 1. In accordance with a preferred version of the invention, the gaming apparatus or machine 20 preferably comprises a slot machine. Slot machines 20 are well-known.

In general, the machine includes an outer housing 28. The game display means 22 take the form of multiple windows 30*a,b,c* within which reels 31*a,b,c* having indicia 32 thereon rotate. An arm 34 is pivotally mounted to the machine 20 for use by a user in activating the machine for spinning the reels 31*a,b,c*. Alternatively, the player may activate the game by pushing a game activation button 36 located on the housing 28.

Each reel 31*a,b,c* preferably has a number of different indicia printed thereon. The reels 31*a,b,c* are mounted so as to spin or otherwise move so that different of the indicia thereon are displayed in the windows 30*a,b,c* in response to a player playing the game.

A player places a bet by inserting a coin or token into a coin or token slot 38. Instructions and predetermined indicia winning combination payout information 40 are printed or otherwise displayed on the front of the housing 28.

A central processing unit (CPU) and related circuitry and mechanical apparatus (well known in the art) are utilized to monitor coin or token payment, to spin the reels in response to a player's pull of the arm 34 or pushing of the button 36, and to pay the player a winning amount if he receives a predetermined winning combination.

In accordance with the present invention, the machine 20 further includes indicator means 26. In a first embodiment of the present invention, the indicator means 26 comprises a light bar 42 comprising a number of individual lights arranged in a row. In the embodiment shown, the light bar 42 comprises ten lights arranged in a horizontal row at the top of the machine 20.

The indicator means 26 are connected to the CPU unit of the machine 20. Preferably, when a player loses a game on the machine, one of the lights of the light bar 42 lights up. When a player loses successive games, the CPU is programmed to light up lights on the light bar 42 in succession, from left to right.

If a player is a winner, i.e. receives a predetermined winning combination, the CPU is programmed to turn off all of the lights of the light bar 42.

The machine 20 preferably includes successive loss counting means, such as a counter, for counting the number of successive losses on the machine. In accordance with one form of the invention, the counter tracks losses and generates a different signal corresponding to each successive loss total. The machine preferably also includes a comparator which receives the signals generated by the counter and compares them to a predetermined jackpot signal. The comparator triggers the CPU to pay the jackpot when the "jackpot" signal is transmitted by the counter to the comparator. After payment of the jackpot or upon a win, the counter is reset. Comparators and counters are well-known in the art.

The CPU is thus programmed to pay a winning or jackpot amount to a player if the result of a number of successive losing spins is achieved. A losing spin may be either a spin in which fewer credits are repaid than played, or, preferably, in which no credits are paid out. Preferably, the CPU is programmed to pay a jackpot if at least five, more preferably eight, and still more preferably at least ten successive spins played on the machine are losing spins.

The jackpot amount paid in the event that the predetermined number of successive losing games are played is preferably in an amount of at least 100 times, preferably 200 times, the amount bet, more preferably in an amount of at least 500 or 1000 times the amount bet, and most preferably in an amount of 5000 times or more the amount bet.

Play of a game in accordance with the present invention is as follows. A player places a bet, such as by inserting one or more tokens or coins into the slot 38 of the machine 20 or playing a "credit." As used herein, playing a "credit" can include inserting a coin, token, paper currency, credit card, debit card, or any other form of payment required to actuate a machine. The player activates the machine 20 by either pulling the arm 34 or pushing the button 36.

Once the arm is pulled or button pushed, the machine rotates the reels 31*a,b,c*. The reels 31*a,b,c* spin for some time, and then stop with one indicium on each reel 31*a,b,c* visible through each window 30*a,b,c*. If the combination of the displayed indicia is a predetermined winning combination of indicia, the player is paid a predetermined winning amount, and any previously illuminated indicator lights of the light bar 42 are turned off.

If the combination of displayed indicia is a predetermined losing combination (i.e. the game is a "losing game") the first of the lights of the light bar 42 is illuminated, or if the first light is already illuminated, the next of the unlit lights of the bar in succession is illuminated. If the light which is lit is the tenth light, representing the tenth successive losing game played on the machine, the player is paid the jackpot amount.

The light bar 42 may be arranged and take on many different forms from that described above. For example, the light bar 42 may comprise individual light elements, and the lights may be arranged diagonally, vertically or in a variety of other patterns.

The light bar 42 may comprise transparent or semi-transparent element which are lit from behind. Alternatively, the light bar 42 may comprise an LED or LCD display which illuminates block or numeral elements, or may be a simple digital numeric number which increments by one with each successive loss.

Figure 2:
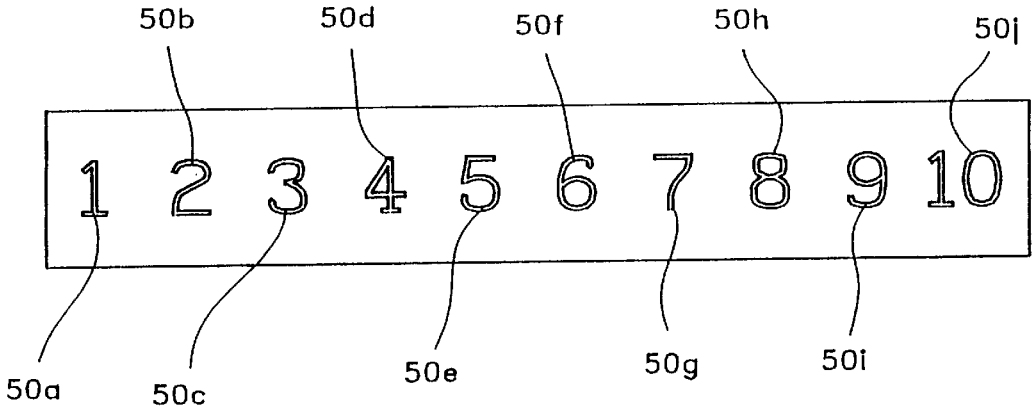
FIG. 2 illustrates a first alternate form of an indicator for use with a gaming machine such as that illustrated in FIG. 1.

In accordance with the present invention, the indicator means 26 may comprise a number of means other than the light bar 42. FIG. 2 illustrates an alternate embodiment indicator means. In this illustration, the indicator means comprises numerals 50*a–j*. Preferably, each numeral 50–j comprises a partially transparent element which can be illuminated from behind. As with the light bar 42 described above, each numeral 50*a–j* is preferably illuminated in order in response to losing games.

Figure 3:
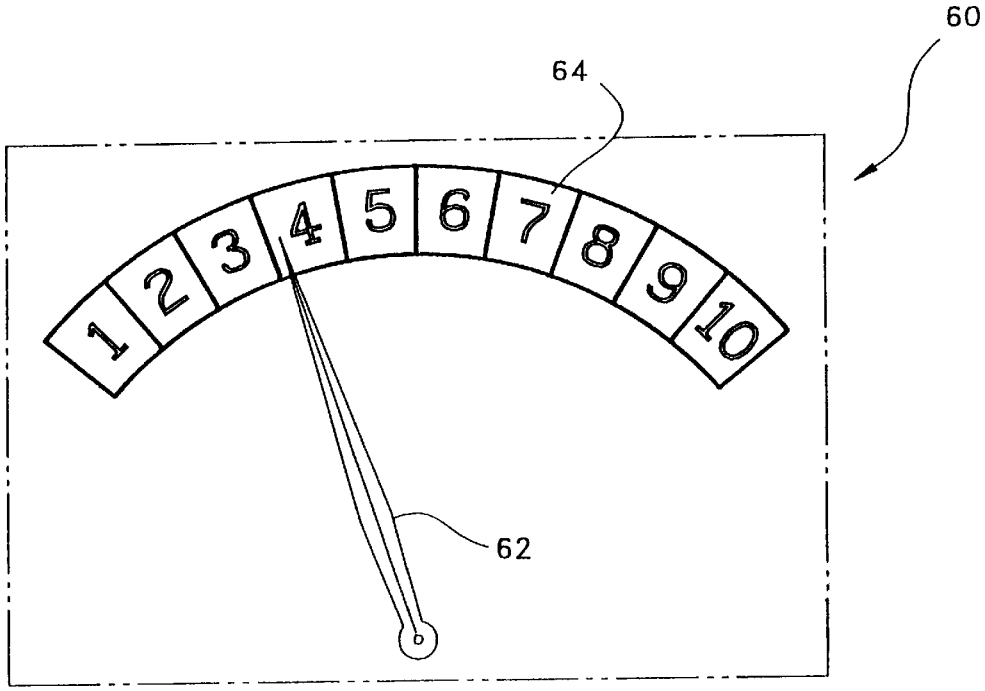
FIG. 3 illustrates a first alternate form of an indicator for use with a gaming machine such as that illustrated in FIG. 1.
Figure 4:
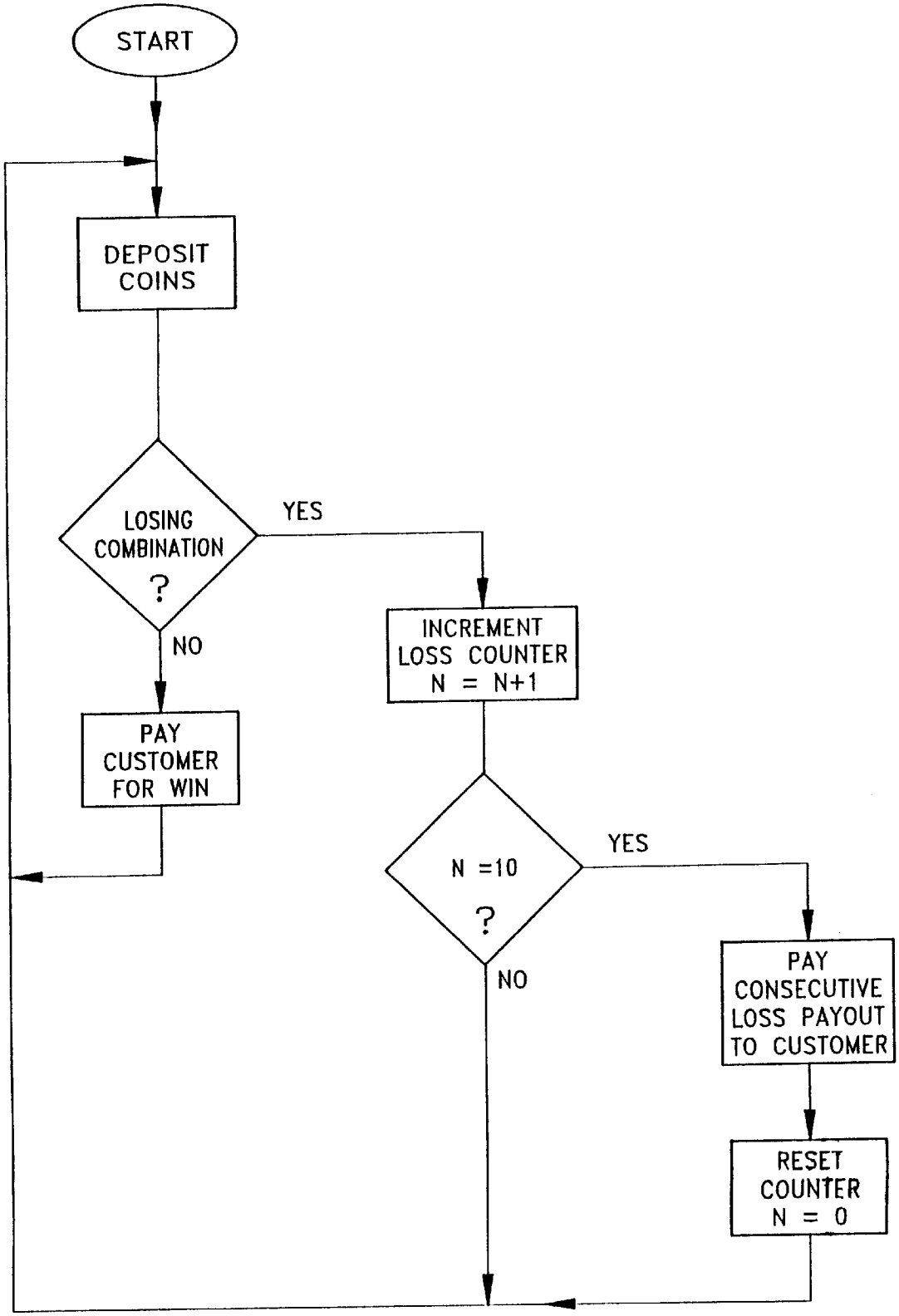
FIG. 4 is a flow diagram for the invention.

In FIG. 3, the indicator means comprises a meter 60. The meter 60 includes markings 64 and a pointer 62. The pointer 62 is preferably controlled by a motor or other means, and moves in response to a player losing a game. If one or more games have been lost in succession, the point 62 preferably points to the number of successive losses.

In a variation of the above-referenced game, a winning jackpot may be paid if a predetermined number of losing game results are obtained out of a predetermined number of games, such as 9 of 10 or 19 of 20. Also, while it is preferred that the jackpot be paid upon ten successive losing games, the number of successive games may alternatively be 5, 15 or more.

The game of the present invention can be played in conjunction with a slot machine having other than three reels, such as a four or five reel machine. The game may also be played with a slot machine having multiple pay lines, as is known in the art. In that instance, it may be desirable to indicate multiple losses in a single play of the game.

For example, in some types of slot machines, multiple reel indicia are shown, with a winning result occurring if any of two, three or more rows or other combinations of reel indicia form a predetermined winning combination. In that instance, if a player plays and none of the multiple pay times or chances to win are winners, the player may be considered a multiple loser. In accordance with the present invention, multiple losses might then be credited and displayed by the indicator means.

It should be understood that while the slot machine described in the preferred embodiment has spinning reels under windows, slot machines employing video technology are equally applicable for use in the game of the present invention.

There are numerous methods to design the specific play of a gaming machine in accordance with the present invention. In each case, the probabilities associated with a player winning a major jackpot through a number of successive no-payout plays must be designed to statistically provide the owner of the machine with a profit. All slot machines are programmed, either by computer or by the sequence of appearances of winning symbols on reels, to enable the house to retain a specific percentage of the coins played over an infinite period of time.

While the percentage held by the house may vary from machine to machine, or may be varied by the owner of the machine, at any given time the percentage is fixed and precisely calculable. The design of the machine in accordance with the present invention requires that a major jackpot, e.g., at least several hundred times the amount played on a particular pull of the machine, be paid out after a number of successive losing pulls. This poses a somewhat unusual design challenge, since players are accustomed to having some return on the play of a machine. If no coins or credits are earned after a certain amount of play, the player will lose interest and move on.

In a conventional machine which pays a very large jackpot based on display of a certain predetermined combination of jackpot symbols, the machine can be set to hit the specific jackpot as infrequently as desired; e.g., once in several million plays. This creates a relatively simple design challenge. However, in order to pay out a very large jackpot based on a predetermined number of losing spins, and to keep the probability of winning a major jackpot appropriately low, either (i) the probability of losing each spin must be quite low, if the losing each spin is the r losing each spin is the same, or (ii) the probability of losing at least one of the spins in the succession of losing spins must be very low, if the probability of winning or losing successive spins may vary. This concept is most easily understood by example.

If, hypothetically, there were a 50% chance of a win on each spin, the probability of ten successive losses is $2^{10}$ or one in 1024. This probability is too high to justify a very large jackpot. On the other hand, if the probability of winning on each spin is increased substantially in order to get the probability of ten successive losses appropriately decreased, the house will be unable to obtain a necessary edge to have the machines pay profitably. Thus, it is necessary to find a system of probabilities which fit the intention of the game.

In the United States, gaming laws are regulated on a state-by-state basis. In most states, gaming regulations require that the probability of achieving any given result on a gaming machine be identical each time the machine is actuated. In this case, there are several methods in which an appropriate probability table can be achieved.

One method would be to require that for a player to have a chance of achieving the largest jackpot payable by the machine, the player would need to insert a plurality of coins (or play a plurality of credits). This is the method of eligibility required for the "Megabucks®" array of machines which is currently in use in the State of Nevada. In this format, a "loss" would occur if a player received back less than the total number of coins or credits played. For example, if the player played three credits, and the result was a payout of two credits, this result would be considered a "win" for the purpose of achieving ten successive losses. Thus, from a standpoint of actually winning or losing, a payout of one or two coins or credits after playing three coins is in fact a loss, but would be considered a win when calculating ten successive losses. Under these circumstances, adjustment of the probabilities to pay out a very large jackpot in the event of ten successive losses can be done relatively easily, because the machine can be set to pay out one or two coins on nearly every play.

A preferred method of setting the probabilities such that a fixed number of sequential losses obtains a major jackpot is to vary the probability of winning with each successive spin as successive losses are achieved. In other words, if a first spin results in a zero payout, the probability of winning on the second pull may be different from the probability of winning on the first pull. Similarly, the probabilities of winning on each successive pull may vary if successive losses are achieved. Again, having the ability to change the probabilities of winning on each successive spin after successive losses facilitates an easy calculation of probabilities necessary to generate a major jackpot through a fixed number of losses.

In political jurisdictions which require that the probabilities of success be the same on each actuation of the machine, this problem may be overcome by requiring the player to prepay for a fixed number of plays equal to the number of successive losses required to achieve the major jackpot. For example, if the major jackpot is achieved after ten successive losses, a player would be required to prepay ten coins or credits prior to the first spin. The initial credits would be decremented with each spin, and if a winning spin was achieved, the remaining credits would also be paid out. For example, if a winning result were achieved on the fourth spin, the remaining six credits would be returned to the player.

Although ten spins would be required to achieve the jackpot, and each spin may have a different probability of winning or losing, the overall probability for the ten spins would be exactly the same each time the ten credits are inserted into the machine. This would then satisfy the regulatory authorities' requirement of identical probabilities for each play, because one full play of the game may constitute up to ten successive activations of the machine. If a winning spin is achieved prior to ten activations, the unplayed credits are paid out or credited to the player.

An example of this probability scenario follows.

EXAMPLE

This example sets forth the probabilities for each spin of a gaming machine consistent with the invention, wherein ten successive losing (i.e., no payout) results are required to win a payout of 5000 times the amount bet (e.g., a $5,000 jackpot for a $1 bet). This example assumes that ten dollars is played by a player in advance of actuation of the first spin, with a bet of $1 for each spin. Hypothetical probabilities of success are set up in each table for each spin. As can be seen, the probabilities of winning on each successive spin in this hypothetical example in some cases differ from the probabilities of success of the spins which precede or follow each spin. The payout probabilities are shown as frequency of times each winning result is reached in eight million spins.

First Spin This spin will be reached 100% of the time; i.e., after the money is deposited, the player will always use the first credit. The payout probabilities for the first spin are shown in the following table.

| Payback Per Dollar Bet | Payback Frequency Per Eight Million Spins | Total Payback Per Eight Million Spins |
|---|---|---|
| $2 | 3,700,000 | $7,400,000 |
| $3 | 100,000 | $300,000 |
| $5 | 20,000 | $100,000 |
| $7 | 10,000 | $70,000 |
| $20 | 1,000 | $20,000 |
| $100 | 10 | $1,000 |
| $1,000 | 1 | $1,000 |
| Total | 3,831,011 | $7,892,000 |

Thus, on the first spin, the house will keep $108,000 out of the $8 million which has been wagered. The frequency of payout is $3,831,011 divided by eight million or 47.89%. The house expected win is 1.35 cents on the dollar wagered. Thus, 52.11% of the time, a player will lose and will proceed to the second spin in the sequence. If a win is achieved, the remaining nine unused credits are also returned to the player, and the game is over.

Second Spin This spin will be reached 52.11% of the time. The second spin payout table is as follows:

| Payback Per Dollar Bet | Payback Frequency Per Eight Million Spins | Total Payback Per Eight Million Spins |
|---|---|---|
| $2 | 800,000 | $1,600,000 |
| $3 | 20,000 | $60,000 |
| $5 | 2,000 | $10,000 |
| $7 | 2,000 | $14,000 |
| $20 | 100 | $2,000 |
| $100 | 10 | $1,000 |
| $1,000 | 1 | $1,000 |
| | 824,111 | $1,688,000 |

The pay frequency on the second spin is $824,111 divided by $8 million or 10.31%. For each $8 million deposited on the second spin, the house keeps $6,312,000 or 78.9 cents of each dollar played. The house expectation of retainage on the second spin is thus 0.789×0.5211=41.1 cents. The player will lose, and thus proceed on to the third spin 89.7% of the time after the second spin has been completed. The overall probability of reaching the third spin is 0.5211×0.8970=0.467, or 46.7% of the time.

Third Spin The third spin is set to pay out according to the following table.

| Payback Per Dollar Bet | Payback Frequency Per Eight Million Spins | Total Payback Per Eight Million Spins |
|---|---|---|
| $2 | 800,000 | $1,600,000 |
| $3 | 20,000 | $60,000 |
| $5 | 2,000 | $10,000 |
| $7 | 2,000 | $14,000 |
| $20 | 100 | $2,000 |

-continued

| Payback Per Dollar Bet | Payback Frequency Per Eight Million Spins | Total Payback Per Eight Million Spins |
|---|---|---|
| $100 | 10 | $1,000 |
| $1,000 | 1 | $1,000 |
| | 824,111 | $1,688,000 |

This pay table is the same as the second spin. Using the same calculations, after the third spin, the fourth spin will be reached 89.7% of the time. The overall probability of reaching the fourth spin is approximately 0.42. The expectation of the house hold calculates to 36.8 cents on this spin each game.

Fourth Spin This spin will be reached 41.9% of the time. If the fourth spin is reached, the payout table is as follows:

| Payback Per Dollar Bet | Payback Frequency Per Eight Million Spins | Total Payback Per Eight Million Spins |
|---|---|---|
| $2 | 3,700,000 | $7,400,000 |
| $3 | 100,000 | $300,000 |
| $5 | 20,000 | $100,000 |
| $7 | 10,000 | $70,000 |
| $20 | 1,000 | $20,000 |
| $100 | 10 | $1,000 |
| $1,000 | 1 | $1,000 |
| | 3,831,011 | $7,892,000 |

This table is the same as for the first spin. The pay frequency is 47.89%, and 52.11% of the time a player will proceed to the fifth spin after reaching the fourth spin. The overall probability of reaching the fifth spin each game is 21.8% of the time. The house expectation contributed by this spin each game is $108,000÷8,000,000×0.419=0.6 cents.

Fifth Spin This spin will be reached 21.8% of the time each game. If it is reached, the payout is as follows:

| Payback Per Dollar Bet | Payback Frequency Per Eight Million Spins | Total Payback Per Eight Million Spins |
|---|---|---|
| $2 | 50,000 | $100,000 |
| $3 | 700,000 | $2,100,000 |
| $5 | 3,000 | $15,000 |
| $7 | 1,000 | $7,000 |
| $20 | 100 | $2,000 |
| $100 | 10 | $1,000 |
| $1,000 | 1 | $1,000 |
| | 754,111 | $2,226,000 |

This payout schedule results in a payout frequency of 9.43%, meaning that a player will go to the sixth spin 90.57% of the time that the fifth spin is reached. The overall probability of proceeding to the sixth spin is 0.218×0.906=0.198 or 19.8%. The house expectation of retention on the fifth spin is 15.7 cents.

Sixth Spin This spin will be reached 19.8% of the time each game and is set to return a very high payout to the player. The payout table is as follows.

| Payback Per Dollar Bet | Payback Frequency Per Eight Million Spins | Total Payback Per Eight Million Spins |
|---|---|---|
| $2 | 150,000 | $300,000 |
| $3 | 7,000,000 | $21,000,000 |
| $5 | 20,000 | $100,000 |
| $7 | 5,000 | $35,000 |
| $20 | 1,000 | $20,000 |
| $100 | 10 | $1,000 |
| $1,000 | 1 | $1,000 |
| | 7,176,011 | $21,457,000 |

On the sixth spin, the payout frequency is 89.7%, and the expected loss of the house for each $8 million deposited is $13,457,000, or $1.68 per one dollar bet. Overall, the house expects to lose 33.2 cents on the sixth spin each time the game is played. Players completing the sixth spin will proceed to the seventh spin 10.3% of the time.

Seventh Spin The seventh spin will be reached 2.04% of the time each game. If the seventh spin is reached, the machine will payout as follows:

| Payback Per Dollar Bet | Payback Frequency Per Eight Million Spins | Total Payback Per Eight Million Spins |
|---|---|---|
| $2 | 100,000 | $200,000 |
| $3 | 100,000 | $300,000 |
| $5 | 3,800,000 | $19,000,000 |
| $7 | 5,000 | $35,000 |
| $20 | 1,000 | $20,000 |
| $100 | 10 | $10,000 |
| $1,000 | 1 | $1,000 |
| | 4,006,011 | $19,566,000 |

On the seventh spin, the pay frequency is 50.08%, meaning that a player will go to the eighth spin 49.92% of the time after the seventh spin. The house expects a loss on the seventh spin of 2.9 cents per each dollar wagered on the seventh spin.

Eighth Spin This spin will be reached 1.02% of the time each game. If the eighth game is reached, the payout is as follows:

| Payback Per Dollar Bet | Payback Frequency Per Eight Million Spins | Total Payback Per Eight Million Spins |
|---|---|---|
| $2 | 50,000 | $100,000 |
| $3 | 50,000 | $150,000 |
| $5 | 6,000,000 | $30,000,000 |
| $7 | 20,000 | $140,000 |
| $20 | 1,000 | $20,000 |
| $100 | 10 | $1,000 |
| $1,000 | 1 | $1,000 |
| | 6,121,011 | $30,412,000 |

On the eighth spin, the pay frequency is 75.51%, indicating that a player will go on to the ninth spin 23.49% of the time that the eighth spin is reached. The house expected loss is 2.9 cents on each dollar bet on the eighth spin each game.

Ninth Spin The ninth spin will be reached 0.24% of the time. If reached, the machine will pay as follows:

| Payback Per Dollar Bet | Payback Frequency Per Eight Million Spins | Total Payback Per Eight Million Spins |
|---|---|---|
| $2 | 50,000 | $100,000 |
| $3 | 50,000 | $150,000 |
| $5 | 200,000 | $1,000,000 |
| $7 | 6,000,000 | $42,000,000 |
| $20 | 100,000 | $2,000,000 |
| $100 | 1,000 | $100,000 |
| $1,000 | 10 | $10,000 |
| | 6,401,010 | $45,360,000 |

The ninth spin is programmed to pay heavily in favor of the player. In this pay table, the machine will pay $7 for each one dollar bet 75% of the time. This payout is set to be very attractive to players who reach this level of the game, and since the player will lose the opportunity to go to the tenth spin after eight successive losses, the payout is very generous. The pay frequency is 80.01% of the time on the eighth spin with the house expecting to lose $4.67 for each one dollar bet. This calculates to an expected loss of 1.1 cents for each dollar bet on the ninth spin each time the game is played. Players reaching the ninth spin will proceed to the tenth spin 19.99% of the time.

Tenth Spin This spin will be reached 0.048% of the time, and if reached, the machine will pay as follows:

| Payback Per Dollar Bet | Payback Frequency Per Eight Million Spins | Total Payback Per Eight Million Spins |
|---|---|---|
| $2 | 10,000 | $20,000 |
| $3 | 10,000 | $30,000 |
| $5 | 10,000 | $50,000 |
| $7 | 70,000 | $490,000 |
| $20 | 7,100,000 | $142,000,000 |
| $100 | 100 | $10,000 |
| $1,000 | 10 | $10,000 |
| FIVETHOUSAND | 799,890 | $3,999,450,000 |
| DOLLAR JACKPOT | | |
| | 8,000,000 | $4,142,060,000 |

Thus, on the last spin, for each $8 million deposited, the house gives back $4,142,060,000 which is a loss of $517 per dollar bet. However, this loss occurs only 0.048% of the time, or is a loss expectation of 24.8 cents for each dollar played on the tenth spin each time the game is played and the tenth spin is reached.

The following table sets for the total expected value for the house contributed by each spin of the machine following the insertion of $10 by the player.

| | |
|---|---|
| FIRST SPIN | 1.35 cents |
| SECOND SPIN | 41.1 cents |
| THIRD SPIN | 36.8 cents |
| FOURTH SPIN | .6 cents |
| FIFTH SPIN | 15.7 cents |
| SIXTH SPIN | (33.2 cents) |
| SEVENTH SPIN | (2.9 cents) |
| EIGHTH SPIN | (2.9 cents) |

-continued

| | |
|---|---|
| NINTH SPIN | (1.1 cents) |
| TENTH SPIN | (24.8 cents) |
| | 30.7 cents |

Accordingly, in the probabilities set forth in this hypothetical example, the house wins approximately 31 cents for each ten dollars bet, resulting in a payback to the player of approximately 97%.

The foregoing example is simply a specific hypothetical example of a probability sequence for play of the game which requires prepayment of ten dollars prior to play, and which enables up to ten successive actuations of the machine should successive losses be achieved. Should a winning result be obtained prior to ten successive losses, the remaining unused portion of the initial bet is returned to the player. This scenario establishes a mechanism for programming the machine to pay out a very large jackpot, i.e., $5,000, while maintaining the probabilities of success identical each time a full game (amounting to a bet of ten coins) is played. Of course, the probabilities of each spin can be varied, and the number of coins or credits prepaid can be altered, depending on the result desired for the game. In addition, the total jackpot can also be varied to suit the house's desires.

The concept of using sequential plays of a game, each of which has a different set of probabilities of winning and losing, to achieve a desired result after payment of an initial credit of multiple coins can be used in any number of games. This system satisfies the requirement of gaming regulatory authorities that each game be subject to the same set of probabilities each time the game is played. However, since a game consists of multiple events, each of which may have different probabilities, additional flexibility is provided to the game creator.

The present invention can so be played in conjunction with a variety of other games and gaming machines, such as video-poker. Here, whether a game is won or lost is determined by whether the player obtains a predetermined card hand. If the results of multiple games are predetermined losing hands, the player is preferably paid a jackpot amount. If the concept of winning a major jackpot based on a succession of losing hands is applied to video poker, it would of course be necessary to take into account when setting probabilities, the fact that a player could intentionally attempt to draw a losing hand by discarding winning possibilities.

It will be understood that the above described arrangements of apparatus and the method therefrom are merely illustrative of applications of the principles of this invention and many other embodiments and modifications may be made without departing from the spirit and scope of the invention as defined in the claims.

I claim:

1. A device for playing a game in which a jackpot amount is awarded upon achieving a pre-determined numbered set of consecutive losing spin outcomes comprising:

a game display;

a plurality of spinning reels representations each having different indicia and blank spaces thereon;

means for randomly selecting and displaying said indicia and blanks along a payline, the combination of which determines whether an outcome of a spin is a losing or a winning outcome;

means for a player to make a wager and initiate a spin to obtain an outcome;

means for rewarding the player and terminating play of the game set of spins if the player obtains a winning outcome;

means for counting the number of consecutive losing spin outcomes during play of the game set;

means for rewarding the player said jackpot if the player obtains a pre-determined schedule of losing outcomes during play of the game set of spins; and means for providing differing probabilities for obtaining a winning outcome versus a losing outcome for at least a plurality of the spins of said game set such that the overall probabilities for obtaining a winning outcome during play is substantially the same from game set to game set.

2. The device of claim 1 wherein the set is ten spins and the rewarding means includes means for rewarding the player if the player obtains at least 9 consecutive losing outcome spins.

3. The device of claim 1 wherein the first spin of the set has a first probability of obtaining a winning outcome and the second spin has a lesser, second probability of obtaining a winning outcome.

4. A method for providing a game using a plurality of spinning reels, or electronic representations thereof, having different indicia thereon to produce outcomes of different combinations of indicia, in which a jackpot amount is awarded upon achievement of a pre-determined number of consecutive losing outcomes in a game set having at least three spins, comprising:

(a) for each spin, randomly selecting indicia the combination of which determines whether an outcome of a spin is a losing or a winning outcome, winning outcomes having, for each spin, a probability of occurring versus losing outcomes;

(b) a player making a wager and initiating a first spin of the game set;

(c) displaying the outcome indicia of the first spin;

(d) if the outcome of the first spin is a winning outcome, rewarding the player and terminating play of the game set;

(e) if the outcome of the first spin is a losing outcome, the player making subsequent wagers to play, in series, subsequent spins of the game set wherein at least a plurality of the spins of the game set have a different probability from the other spins of obtaining a winning versus a losing outcome but the overall probability of obtaining a winning outcome during play of the game set is substantially the same from game set to game set;

(f) if the outcome of any subsequent spin is a winning outcome, rewarding the player and terminating the play of the game set; and (g) if the player obtains said pre-determined number of consecutive losing game outcomes in a game set, a warding a jackpot amount.

5. The method of claim 4 including rewarding the player at least 500:1 if the player obtains eight consecutive losing spin outcomes.

6. The method of claim 4 including rewarding the player at least 1000:1 if the player obtains ten consecutive losing spin outcomes.

7. The method of claim 4 including rewarding the player for obtaining at least five consecutive losing spin outcomes.

8. The method of claim 4 wherein the pre-determined numbered set of losing spin outcomes is at least 10.

9. The method of claim 8 including adjusting the payout frequency for the second spin is less than that for the fist spin.

10. The method of claim 9 wherein the payout frequency value for the first spin is approximately 48% the method including providing the second spin with a payout frequency value of approximately 10%.

11. The method of claim 4 further including providing differing payout frequencies for spins of the set such that the sum of payout frequencies for all spins for each is fixed at approximately 97%.

12. The method of claim 4 including awarding a secondary jackpot for obtaining a number of consecutive losing spins in a game set less than all of said spins of said game set.

* * * * *